US005332126A

United States Patent [19]

Battegazzore

[11] Patent Number: 5,332,126

[45] Date of Patent: Jul. 26, 1994

[54] AUTOMATIC PASTE CONTAINER CLOSURE DEVICE

[75] Inventor: Piero Battegazzore, Alessandria, Italy

[73] Assignee: Guala S.p.A., Alessandria, Italy

[21] Appl. No.: 77,561

[22] Filed: Jun. 15, 1993

[30] Foreign Application Priority Data

Jul. 1, 1992 [EP] European Pat. Off. ..... 92830341.1

[51] Int. Cl.[5] ..... B65D 35/08

[52] U.S. Cl. ..... 222/107; 222/494

[58] Field of Search ..... 222/107, 491, 492, 496, 222/514, 517, 545, 212, 494

[56] References Cited

U.S. PATENT DOCUMENTS

| | | | |
|---|---|---|---|
| 2,249,385 | 7/1941 | Johnsen | 222/496 |
| 2,755,974 | 7/1956 | Godfrey | 222/494 |
| 2,757,828 | 8/1956 | Wilson | 222/496 |
| 2,788,160 | 4/1957 | Hertz | 222/492 |
| 4,936,493 | 6/1990 | Foster et al. | 222/212 X |

*Primary Examiner*—Gregory L. Huson
*Attorney, Agent, or Firm*—Edward D. Manzo

[57] ABSTRACT

A device for the automatic opening and closing of a container for pastes, such as toothpaste and the like, including a compressable tubular body closed at one end and provided with a dispenser head includes a dispensing duct including two portions at an angle forming an intersection aperture. A piston is positioned to slide sealingly inside the first portion of the dispensing duct so that it closes the intersection aperture when at rest but opens it when the user squezees the tubular body forcing the paste into the first portion of the dispensing duct. The piston is connected by its rod, through an aperture in the first portion of the dispensing duct, to a resilient arm supporting a plate-like element which covers the outlet orifice through which the product is dispensed. The movement of the piston also opens the outlet orifice and accumulates elastic energy in the arm which automatically returns the device to its closed position.

20 Claims, 3 Drawing Sheets

AUTOMATIC PASTE CONTAINER CLOSURE DEVICE

The present invention relates to a device for automatically opening and closing a paste container having a tubular body, deformable by compression, closed at one end and provided with a head for dispensing the product at the other. The dispenser head includes a dispensing duct having an inlet orifice inside the tubular body and in communication with the paste and an outlet orifice in communication with an external environment, a plate-like element moving tangitally to the outlet orifice for opening and closing the outlet orifice, a support arm connected to the dispenser head for supporting the plate-like element and resilient means for biasing the plate-like element to a closed position thus closing the outlet orifice.

Devices as described above are useful in the packaging of products such as toothpaste, shaving cream, ointments and the like.

BACKGROUND OF THE INVENTION

Examples of early embodiments of similar devices are illustrated in the German Patent DE-A-2 030 525 and the U.S. Patent, U.S. Pat. No. 4,032,051.

However these prior art devices are not without disadvantages which compromise their operation during repeated cycles of compression and release of the tubular container to dispense the product.

The device disclosed in the German patent has the disadvantage of imperfect tangential wiping of the output orifice of the dispensing duct because of the presence, inside the duct, of a lifting tab extending in proximity to the output orifice, where it connects with the plate element at an angle that diminishes the wiping effect of the edge of the latter.

The device disclosed in U.S. Pat. No. 4,032,051, while having the advantage of tangential wiping of the output orifice, has the disadvantage of leaving a quantity of material exposed to the external environment after the orifice is closed, with the consequential risk of blockage of the orifice.

The object of the present invention is to eliminate the disadvantages associated with prior art devices while providing a device of simple structure and high reliability in use.

BRIEF DESCRIPTION OF THE DRAWINGS

The invention will now be described and illustrated at greater length with reference to several embodiments, given purely as non-limitative examples in the appended drawings, in which.

DESCRIPTION OF THE PREFERRED EMBODIMENTS

Figure 1:
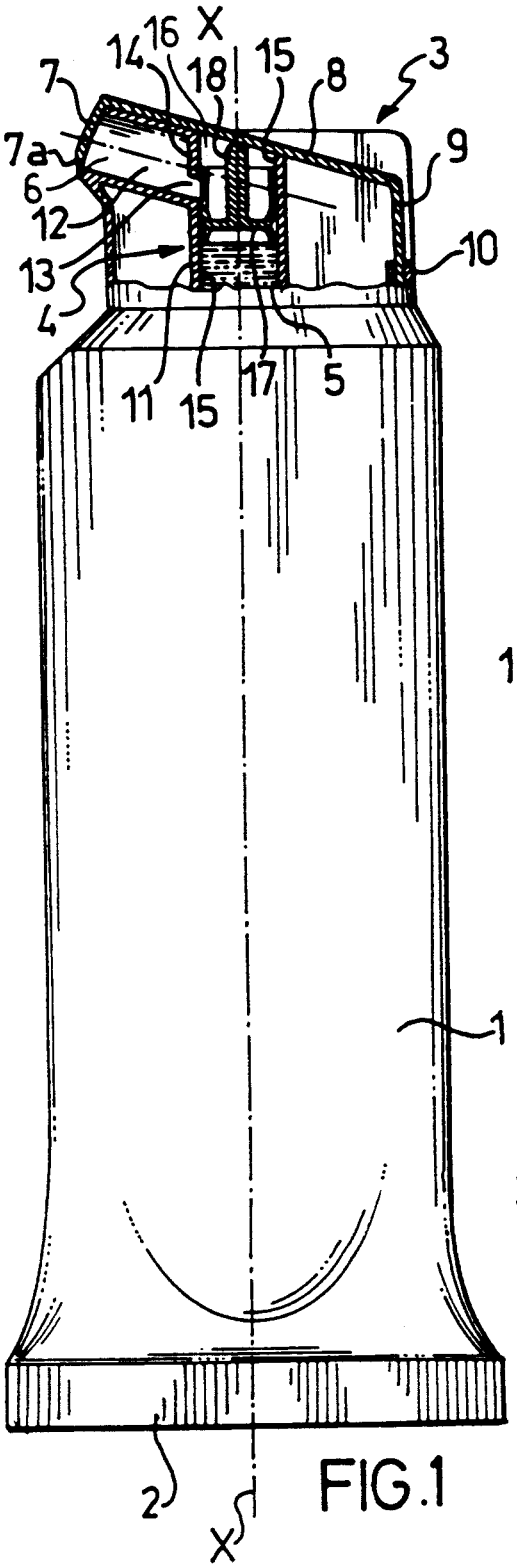
FIG. 1 is a lateral view, in partial cross-section, of a first embodiment of the device according to the invention in its closed position.

With reference to the above mentioned drawings, the tubular body 1 is manufactured from a non-rigid compressable material and is adapted to contain a paste, for example toothpaste, shaving cream, medicated ointments and the like.

The tubular body 1, capable of being closed at end 2 after being filled, is joined at the other end to a dispenser head 3.

This dispenser head 3 includes a dispensing duct 4 with an inlet orifice 5 inside the tubular body 1 and an outlet orifice 6 in communication with the external environment.

In front of the outlet orifice 6 is positioned a plate-like element 7 used to open and close the orifice 6 in a way which is described later.

Figure 3:
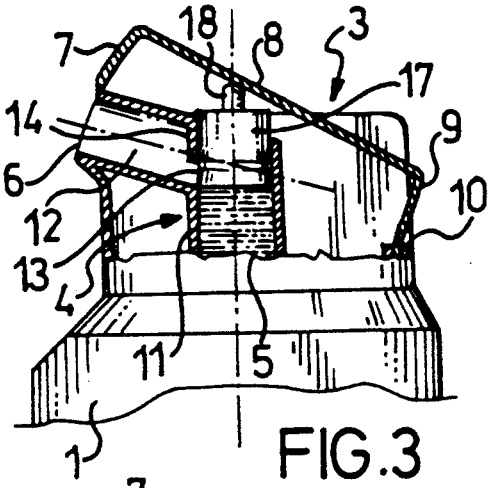
FIG. 3 shows a cross-section of the device of FIG. 1 in a partly open position.
Figure 4:
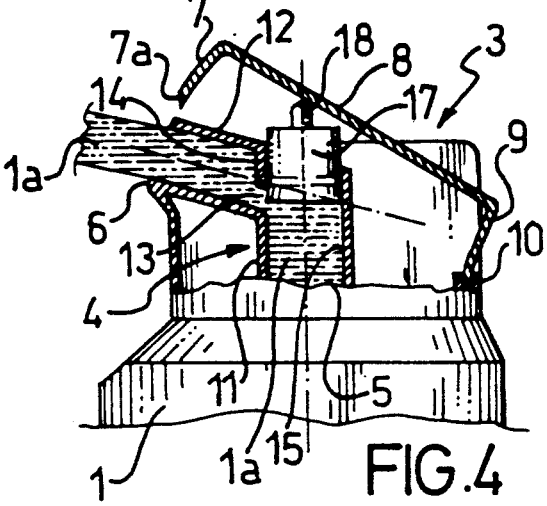
FIG. 4 shows a cross-section of the device of FIG. 1 in an open position ready to dispense the product.
Figure 2:
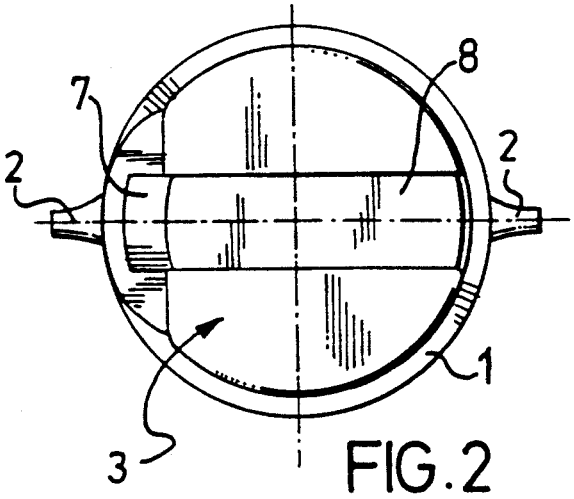
FIG. 2 is a view from above of the device of FIG. 1.
Figure 5:
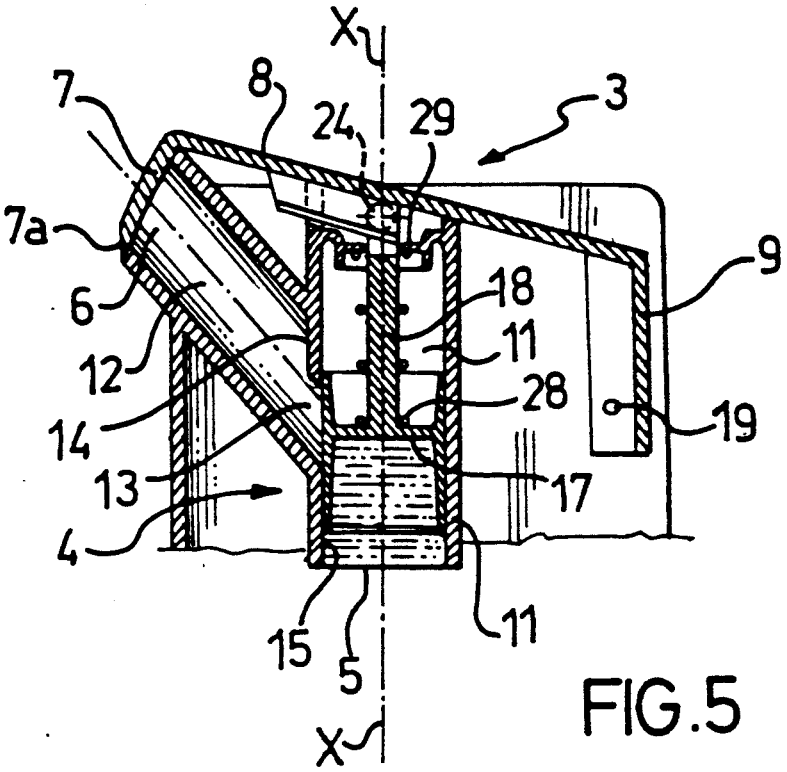
FIG. 5 is a lateral view, in partial cross-section, of a second embodiment of the device according to the invention in its closed position.
Figure 6:
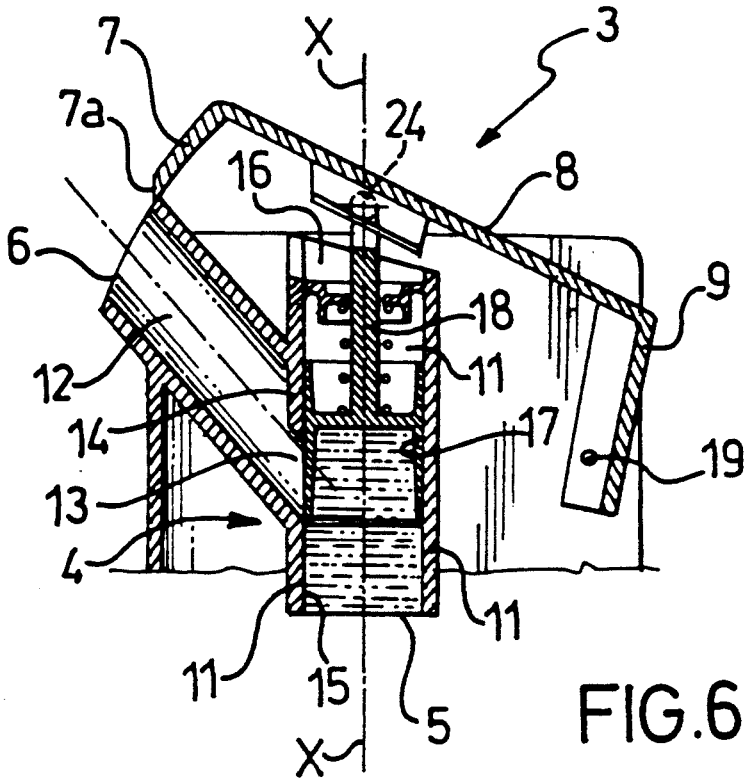
FIG. 6 shows a cross-section of the device of FIG. 5 in a partly open position.

With reference in particular to FIGS. 1 through 4, it will be noted that the plate-like element 7 is connected to a support arm 8 whose bent end 9 is held by a fixture 10 to the dispense head 3. The arm 8, in particular its bent end 9 is made of a flexible elastic material such that arm 8 and bent end 9 can bend at least at the fixture 10 as shown in FIGS. 3 and 4.

The dispensing duct 4 includes a first portion 11 extending parallel to the longitudinal axis X—X of the tubular body 1 and a second portion 12 at an angle to the first portion 11 thus forming an intersection aperture 13. Intersection aperture 13 is reduced by a wall 14 coaxial with the first portion 11 and coplanar with inner surface 15 of the first portion 11.

The first portion 11 is further comprised of an axial aperture 16 opposite the inlet orifice 5 .

Inside the first portion 11 of the dispensing duct 4 there is a piston 17 sealingly slidable axially along the inner surface 15 between a first position, as shown in FIG. 1, in which the piston 17 completely covers the intersection aperture 13 and a second position, as shown in FIG. 4, in which the aperture 13 is at least partially open and in communication with the first portion 11.

The piston 17 is provided with an axial rod 18 which passes through the axial aperture 16 to engage arm 8.

The device operates in the following manner.

Compression of the tubular body 1 cause a paste 1*a* contained within tubular body 1 to flow into the first portion 11 of the dispensing duct 4.

The flow of past 1*a* moves the piston 17 axially from the first position shown in FIG. 1 to the second position shown in FIG. 4 passing intermediately through the position shown in FIG. 3.

The uncovering of the intersection aperture 13 caused by the movement of piston 17 allows the paste it enter the second portion 12 of the dispensing duct 4 and reach the outlet orifice 6 which has been opened in the following fashion.

When the piston 17 starts to move, the rod 18, attached to the piston 17 and in contact with the arm 8, pushes on the arm 8 causing both arm 8 and the plate-like element 7, which at the start of the operation had covered the outlet orifice 6, to lift upward.

This movement occurs against a resilient deformation of the arm 8 and the end 9, engaged to the dispenser head 3 by fixture 10.

The accumulated energy caused by this motion is returned when compression of the tubular body 1 ends, with the result that the plate-like element 7 returns to cover the outlet orifice 6 in a tangential movement that wipes the outlet orifice 6.

Specifically, the wiping action is carried out by an edge 7*a* which is formed like a blade.

In addition to returning the plate-like element 7 to the closed position, the movement of arm 8 also causes the piston 17 to slide back down the first portion 11 of the dispension duct 4, thereby closing the intersection aperture 13.

Referring now to FIGS. 5 through 8, it will first be observed that structural elements had in common with the embodiment illustrated in the previous drawings are indicated with the same reference numbers.

It will also be observed that in the particular embodiment illustrated in FIGS. 5 through 8, the end 9 of the arm 8 is connected to the head 3 by a pivot 19 around which arm 8 can rotate freely while an end 20 of the rod 18 is slidably connected to the arm 8 in a way which ensures that the rod 18 and the arm 8 are coupled.

Figure 8:
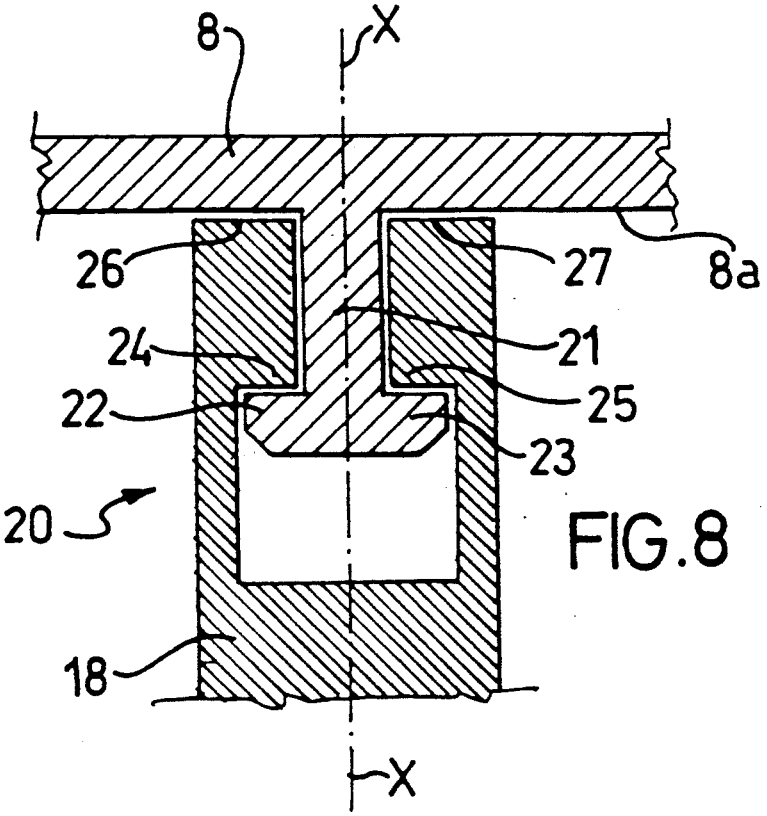
FIG. 8 shows in enlarged scale a cross-section taken on the line VIII—VIII of FIG. 7.

As will be seen in greater detail in FIG. 8, the arm 8 is provided with a longitudinal rib 21 in contact with the end 20 of the rod 18. The rib 21 ends in two lateral projections 22, 23 which snap engage two opposite tabs 24, 25 located at the end 20 of the rod 18. During rotation of the arm 8 round the pivot 19, the opposite tabs 24, 25 slide longitudinally against the projections 22, 23 allowing the rod 18 to remain in its axial position with respect to longitudinal axis X—X.

At the same time, a positive contact between the rod 18 and the arm 8 is ensured because extremities 26, 27 of the tabs 24, 25 are in contact with a lower surface 8*a* of the arm 8.

In the embodiment illustrated in FIGS. 5 through 8, the resilient biasing means for returning the arm 8 to the closed position after the dispension of the paste 1*a* consists of a coil spring 28 concentric with the rod 18. This spring 28 presses at one end axially against the piston 17 and at the other and axially against a radial edge 29 formed in the first portion 11 of the dispensing duct 4 near the axial aperture 16.

Figure 7:
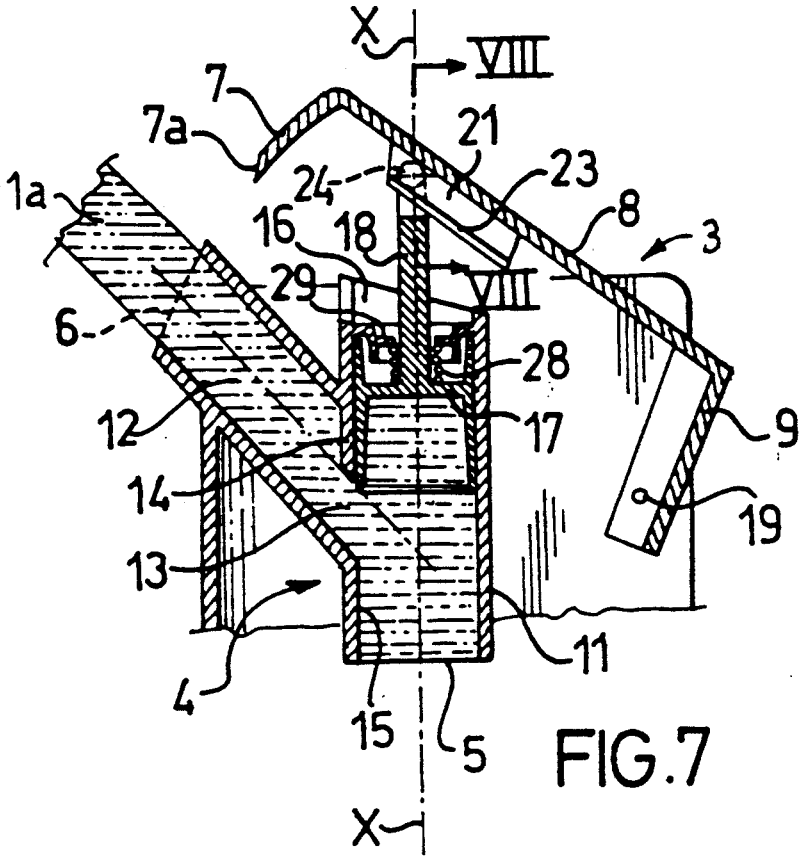
FIG. 7 is a cross-section of the device of FIG. 5 in an open position ready to dispense the product.

During operation the spring 28 is compressed as illustrated in FIG. 7 by movement of the paste 1*a* in duct 4, and when compression of the tubular body 1 ends, the accumulated elastic energy is returned such that the piston 17 returns to the first position and the rod 18 allows the arm 8 with the plate-like element 7 to return to their closed positions.

The embodiments described above are particularly suitable for containers whose tubular body 1 is made of deformable non-rigid material.

In the case of a tubular body 1 made of elastically deformable material, the return of the walls of the container to their normal position after compression may be suffient to draw the piston 17 back to the first position, thus closing the intersection aperture 13. In this case, the spring 28 may be omitted from the embodiment illustrated in FIGS. 5 through 8 as the energy-storage function is satisfied by the walls of the container body 1.

A device according to present invention overcomes the disadvantages found in known prior art devices and, in particular, efficiently cuts off the paste 1*a* level with the outlet orifice such that no traces of the paste 1*a* are left in contact with the external environment.

I claim:

1. A device for automatically opening and closing a container for pastes, comprising a tubular body, deformable by compression, with a closed end and an open end, and dispenser head attached at the open end for dispensing the paste, in which the dispenser head includes a dispensing duct with an inlet orifice inside the tubular body and in communication with the paste contained within the tubular body and an outlet orifice in communication with an external environment, a plate-like element for opening and closing the outlet orifice capable of movement tangential to the outlet orifice between a closed position and a open position, a support arm for the plate-like element connected to the dispense head, and resilient means for biasing the plate-like element to the closed position, wherein the dispensing duct includes a first and a second portion with respective internal tubular surfaces, that first and second portions intersecting at an angle to form an intersection aperture, and a piston positioned in the first portion sealingly slidable axially along the inner surface of the first portion between a first position in which the piston completely covers the intersection aperture and a second position in which the piston leaves the intersection aperture at least partly open and in communication with the first portion, the piston being in engagement with the resilient biasing means for the plate-like element.

2. A device according to claim 1, wherein the first portion of the dispensing duct extend parallel to the longitudinal axis of the tubular body.

3. A device according to claim 1, wherein the intersection aperture between the first and second portions of the dispensing duct includes a wall coaxial with the first portion and coplanar with the internal surface of the first portion, thus reducing the opening of the intersection aperture.

4. A device according to claim 1, wherein the first portion of the dispensing duct is provided with an axial aperture opposite the inlet orifice.

5. A device according to claim 4, wherein the piston is provided with a rod which passes through the axial aperture of the first portion of the dispensing duct and engages the said support arm.

6. A device according to claim 1, wherein the means for biasing the plate-like element includes an end portion of the support arm of the plate-like element connected by a slot to the dispenser head, the end portion being resiliently deformable.

7. A device according to claim 1, wherein the resilient biasing means for the plate-like element includes a radial edge located at an axial aperture of the first portion of the dispensing duct; a rod attached to the piston; a coil spring coaxial with the rod, the coil spring reacting between the piston and the radial edge; and a positive means for connecting the rod to the support arm of the plate-like element.

8. A device according to claim 1, wherein the body of the container is made of a non-rigid material.

9. A device according to claim 1, wherein the body of the container is made of an elastically deformable material.

10. A device according to claim 2, wherein the intersection aperture between the first and second portions of the dispensing duct includes a wall coaxial with the first portion and coplanar with the internal surface of the first portion, thus reducing the opening of the intersection aperture.

11. A device according to claim 2, wherein the first portion of the dispensing duct is provided with an axial aperture opposite the inlet orifice.

12. A device according to claim 11, wherein the piston is provided with a rod which passes through the axial aperture of the first portion of the dispensing duct and engages the support arm.

13. A device according to claim 3, wherein the first portion of the dispensing duct is provided with an axial aperture opposite the inlet orifice.

14. A device according to claim 13, wherein the piston is provided with a rod which passes through the axial aperture of the first portion of the dispensing duct and engages the support arm.

15. A device according to claim 2, wherein the body of the container is made of a non-rigid material.

16. A device according to claim 2, wherein the body of the container is made of an elastically deformable material.

17. A device according to claim 3, wherein the body of the container is made of a non-rigid material.

18. A device according to claim 3, wherein the body of the container is made of an elastically deformable material.

19. A device according to claim 4, wherein the body of the container is made of a non-rigid material.

20. A device according to claim 4, wherein the body of the container is made of an elastically deformable material.

* * * * *